US009649657B2

(12) United States Patent
Chauvet et al.

(10) Patent No.: US 9,649,657 B2
(45) Date of Patent: May 16, 2017

(54) METHOD FOR DEPOSITING LIQUID ONTO THE LOCKING RING OF A CONTAINER

(75) Inventors: Boris Chauvet, Chalon sur Saone (FR); Frederic Mertz, Ouroux sur Saone (FR); Eric Martin, Fontenay aux Roses (FR)

(73) Assignee: SAINT-GOBAIN EMBALLAGE, Courbevoie (FR)

( * ) Notice: Subject to any disclaimer, the term of this patent is extended or adjusted under 35 U.S.C. 154(b) by 663 days.

(21) Appl. No.: 13/577,107

(22) PCT Filed: Jan. 26, 2011

(86) PCT No.: PCT/FR2011/050149
§ 371 (c)(1),
(2), (4) Date: Sep. 11, 2012

(87) PCT Pub. No.: WO2011/095727
PCT Pub. Date: Aug. 11, 2011

(65) Prior Publication Data

US 2012/0325767 A1 Dec. 27, 2012

(30) Foreign Application Priority Data

Feb. 3, 2010 (FR) ..... 10 50739

(51) Int. Cl.
*B05D 1/28* (2006.01)
*B05C 17/02* (2006.01)

(52) U.S. Cl.
CPC ..... *B05C 17/0207* (2013.01)

(58) Field of Classification Search
USPC ..... 427/428.05
See application file for complete search history.

(56) References Cited

U.S. PATENT DOCUMENTS 3,539,671 A * 11/1970 Nauta ..... 264/102
3,787,326 A * 1/1974 Deyrup ..... 556/62
4,389,266 A * 6/1983 Dembicki et al. ..... 156/69
4,396,655 A * 8/1983 Graham et al. ..... 428/34.4
4,404,703 A 9/1983 Woodall, Jr. et al.
5,237,915 A * 8/1993 Rounsley ..... 100/162 R
5,834,382 A 11/1998 Frebourg et al.
(Continued)

FOREIGN PATENT DOCUMENTS

EP 0 972 751 1/2000
EP 0 767 146 11/2001

OTHER PUBLICATIONS

Veblen "Know Your Knits / Samplings of Weft Knit and Warp Knit Fabrics" Threads Magazine #97, pp. 59-63, available on Nov. 19, 2008.*

(Continued)

*Primary Examiner* — Nathan Empie
(74) *Attorney, Agent, or Firm* — Oblon, McClelland, Maier & Neustadt, L.L.P.

(57) ABSTRACT

The invention provides:

a method for applying a liquid to the rim of a container by transfer from a roller whose surface is composed of a tubular warp or weft knit of 2×1 rib construction;

a glass jar or equivalent container whose rim has a coating of varnish, adhesion promoter or heat-sealing primer formed by an application method;

a jar or equivalent container comprising a seal heat-sealed to the rim.

16 Claims, 1 Drawing Sheet

(56) References Cited

U.S. PATENT DOCUMENTS

| | | | | |
|---|---|---|---|---|
| 2002/0065008 | A1* | 5/2002 | Stanhope | 442/181 |
| 2008/0242524 | A1* | 10/2008 | Dilyard et al. | 492/48 |
| 2009/0271938 | A1 | 11/2009 | Yamaguchi et al. | |

OTHER PUBLICATIONS

International Search Report Issued Apr. 6, 2011 in PCT/FR11/050149 Filed Jan. 26, 2011.

* cited by examiner

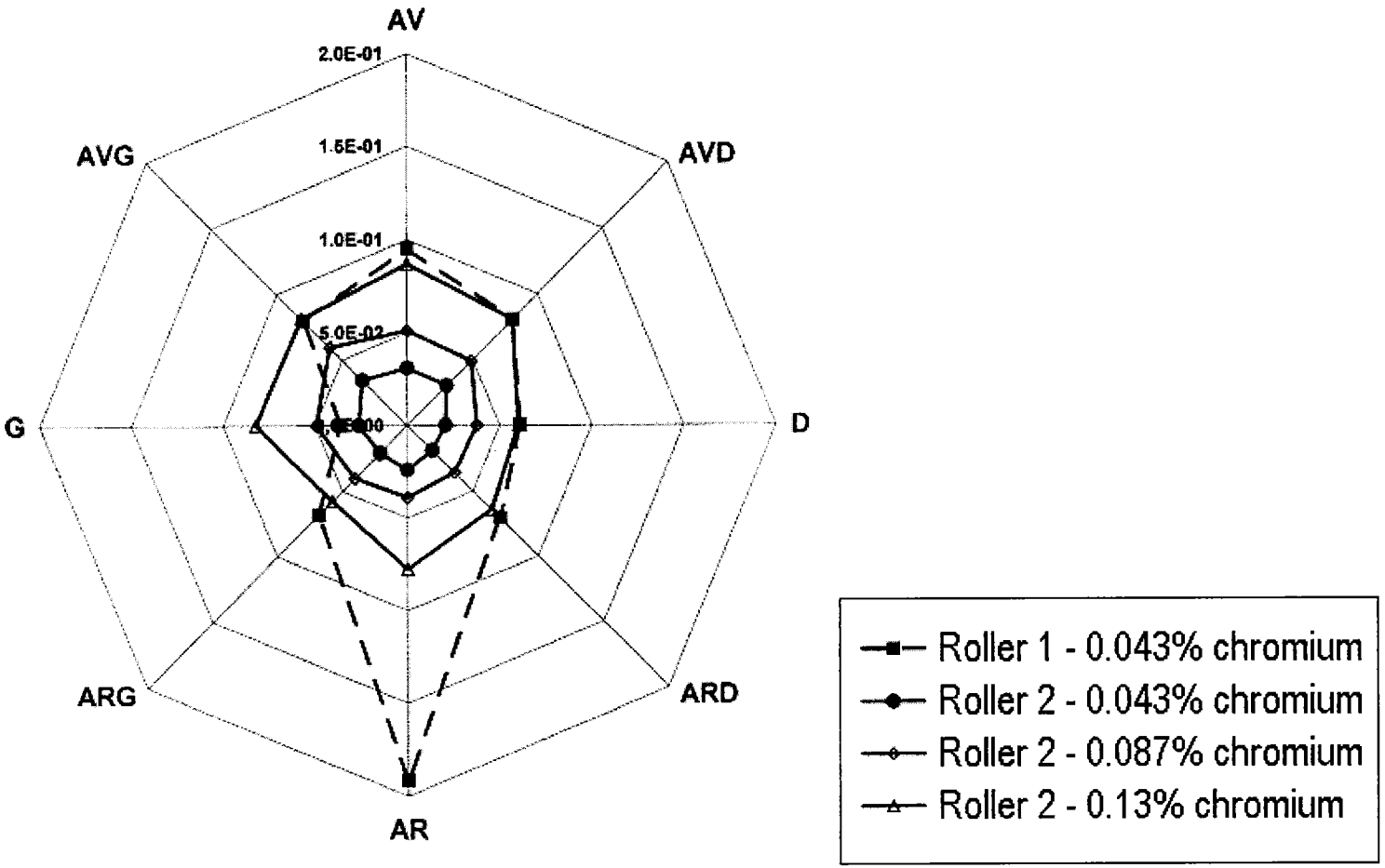
AV
AVD
D
ARD
AR
ARG
G
AVG
2.0E-01
1.5E-01
1.0E-01
5.0E-02
0.0E+00
Roller 1 - 0.043% chromium
Roller 2 - 0.043% chromium
Roller 2 - 0.087% chromium
Roller 2 - 0.13% chromium

METHOD FOR DEPOSITING LIQUID ONTO THE LOCKING RING OF A CONTAINER

The present invention relates to the application of a liquid to the rim of a container such as a jar, bottle, flask or decanter, etc., more particularly made of glass. The aim in particular is to realize this application to large runs of articles on the industrial scale. The geometry of the surface which said rim constitutes is arbitrary, being often annular, but also oval, substantially rectangular or of some other kind.

A further aim is to form coatings with a uniform thickness. Thus, in numerous application methods, such as by transfer using a roller, coatings with nonuniform thicknesses are produced, more particularly thicknesses which are greater at the back of the coating, in other words on the part of the surface that comes into contact last with the roller.

Spraying methods may be unsuitable owing to the annular geometry of the surface to be coated; for example, if it is appropriate to avoid coating the inner wall and base of the jar.

Uniformity of thickness in the coating may be of esthetic interest when the coating is a varnish.

It may be of technical and economic interest when the coating is a heat-sealing primer. Said primer is an auxiliary agent in the heat-sealing of a seal composed of an aluminum foil and a thermoplastic resin layer. A heat-sealing primer may give rise to the problems below.

It is known that the alkaline constituents of glass are capable of migrating through the coating of heat-sealing primer to its surface, in such a way as to cause leakage problems after heat-sealing. This migration takes place throughout the time for which the articles are stored prior to their use; the longer its duration, the greater the minimum thickness of primer. Accordingly, an aim may be to increase this minimum thickness.

In so doing, however, it is appropriate to prevent as far as possible nonuniformities in the thickness of the coatings of heat-sealing primer. The aim is therefore to obtain, from this heat-sealing primer, a barrier of relatively large and uniform thickness.

This objective is achieved by the invention, which provides a method for applying a liquid to the rim of a container by transfer from a roller, the distinctive feature of the method being that the surface of the roller is composed of a tubular warp or weft knit.

The tubular knit does not have any sewing.

A weft knit comprises rows of interlaced loops which are formed from a single yarn. There are a number of classes or constructions of weft knits: jersey, rib, interlock, Milano, punto di Roma, purl (garter, moss, mesh-effect design knit, tuck).

Warp knits include charmeuse, atlas and jacquard.

A transfer roller whose surface is composed of a tubular warp or weft knit produces, on the rim of a container, a liquid coating with a uniform thickness, more particularly a thickness which is not greater at the back of the coating, in contrast to all of the transfer roller materials used up until now.

The knit preferably has a rib construction, encompassing cardigan rib, Richelieu and 1×1, 2×1, 2×2, 3×3 and 4×4 constructions, etc. However, particular preference is given to a 2×1 rib construction.

The knit advantageously comprises a natural or synthetic fiber, more particularly a para-aramid fiber.

The linear density of the yarn which makes up the tubular knit is its number of meters per gram, which can be expressed in Nm (metric number).

According to other preferred features of the method of the invention:

- the knit comprises a yarn with a metric number of between 1/002 Nm and 1/330 Nm, preferably between 1/010 Nm and 1/080 Nm;
- the tubular knit directly covers a fabric, more particularly a denim, or a foam or a material which is resilient, more particularly a solid or cellular silicone or rubber;
- said container is a jar or other container (bottle, flask, decanter, etc.), more particularly of glass.

The invention further provides a glass jar or equivalent container whose rim has a coating of varnish, adhesion promoter or heat-sealing primer formed by an application method as described above. A varnish is able to give rise to a desired esthetic appearance, to protection with respect to radiation, etc.; an adhesion promoter reinforces the adhesion of a seal, for example, and/or the durability of that adhesion; and a heat-sealing primer promotes, for example, sufficient, durable adhesion of a seal likewise.

Consequently, in one particularly desirable embodiment of the glass jar or equivalent container of the invention, the container comprises a seal heat-sealed to the rim.

The invention is now illustrated by the exemplary embodiment below.

EXAMPLE

In this example, the proportions are by mass, unless indicated otherwise.

An adhesion promoter is applied to glass jars having an outer collar diameter of 54.4 mm and a rim width of 4.2 mm.

The adhesion promoter is an aqueous solution of a complex of chromium(III) nitrate and fumaric acid $[Cr(H_2O)_5(O_4H_3O_4)](NO_3)_2$, containing 0.13% of chromium(III) and 0.3% of fumaric acid, which is sold by Ardagh Glass Holmegaard A/S from Denmark under the registered trademark Volan®.

This solution is diluted where appropriate with demineralized/deionized water, its concentration being indicated as a proportion of chromium.

Two coating rollers are used: a first roller with a surface composed of a denim, and a second which differs from the first only in that the denim is coated with a tubular knit of 2×1 rib construction, composed of a para-aramid yarn with a metric number of 1/040 Nm (i.e., 40 m/g).

FIG. 1 shows the dry amounts of the adhesion promoter applied to the rim of the jars, at the front of the coating (the part of the rim making contact with the roller first), labeled AV; at the back of the coating, labeled AR, and on the right and left sides of the rim, labeled D and G. These dry amounts are expressed in $\mu g/mm^2$.

The roller coated with denim is labeled roller 1; the roller coated with tubular knit is labeled roller 2.

In FIG. 1 it is seen that coating with the noninventive roller 1 applies a much greater amount at the back of the coating, whereas the thickness of the coating applied with the inventive roller is uniform over the entire circumference of the rim.

It is also noted that, apart from the rear part of the rim, the noninventive roller, from a solution with 0.043% of chromium, applies a dry amount which is equivalent to that applied with the inventive roller from a solution containing 0.13% of chromium. However, these figures do not predict a better outcome in terms of the amount of adhesion promoter consumed in favor of the noninventive roller, since evaluating such an outcome requires other, dynamic measurements.

On the other hand, it is indeed verified that the method of the invention is notable, as already stated, for the uniformity of thickness of the resulting coating. This thickness can easily be regulated through the selection of the concentration of the solution applied.

The invention claimed is:

1. A method for applying a liquid to a rim of a container, the method comprising:

contacting a rim of a container with a roller comprising a liquid, thereby transferring the liquid to the rim of the container, wherein a surface of the roller comprises a tubular warp or weft knit, and the knit comprises a yarn having a metric number of between 1/002 Nm and 1/080 Nm wherein the container is a glass jar, a glass bottle, a glass flask, or a glass decanter, and wherein the liquid is an adhesion promoter or a heat-sealing primer.

2. The method of claim 1, wherein the knit has a rib construction.

3. The method of claim 2, wherein the knit has a 2×1 rib construction.

4. The method of claim 1, wherein the knit comprises a natural or synthetic fiber.

5. The method of claim 4, wherein the knit comprises a para-aramid fiber.

6. The method of claim 1, wherein the knit comprises a yarn having a metric number of between 1/010 Nm and 1/080 Nm.

7. The method of claim 1, wherein the tubular knit directly covers a fabric, or a foam or a material which is resilient.

8. The method of claim 7, wherein the fabric is a denim and the foam or the material which is resilient is a solid or cellular silicone or rubber.

9. The method of claim 7, wherein the tubular knit directly covers a denim fabric.

10. The method of claim 7, wherein the tubular knit directly covers a solid or cellular silicone.

11. The method of claim 7, wherein the tubular knit directly covers a solid or cellular rubber.

12. The method of claim 1, wherein the knit comprises a natural fiber.

13. The method of claim 1, wherein the knit comprises a synthetic fiber.

14. The method of claim 1, wherein the liquid is an adhesion promoter.

15. The method of claim 14, wherein the adhesion promoter is an aqueous solution comprising $[Cr(H_2O)_5(C_4H_3O_4)](NO_3)_2$.

16. The method of claim 1, wherein the liquid is a heat-sealing primer.

* * * * *